US006422675B1

(12) United States Patent
Tomomatsu

(10) Patent No.: US 6,422,675 B1
(45) Date of Patent: Jul. 23, 2002

(54) PRINTING APPARATUS

(75) Inventor: Shigemasa Tomomatsu, Osaka (JP)

(73) Assignee: Funai Electric Co., Ltd., Daito (JP)

( * ) Notice: Subject to any disclaimer, the term of this patent is extended or adjusted under 35 U.S.C. 154(b) by 0 days.

(21) Appl. No.: 09/571,992

(22) Filed: May 16, 2000

(30) Foreign Application Priority Data

May 18, 1999 (JP) ..... 11-137539

(51) Int. Cl.[7] ..... B41J 2/195; B41J 23/00; B41J 2/175

(52) U.S. Cl. ..... 347/7; 347/37; 347/85

(58) Field of Search ..... 347/5, 7, 37, 86, 347/87, 85

(56) References Cited

U.S. PATENT DOCUMENTS 5,438,351 A * 8/1995 Trenchard et al. ..... 347/19

FOREIGN PATENT DOCUMENTS

JP 4-275156 9/1992 ..... B41J/2/175

* cited by examiner

*Primary Examiner*—John Barlow
*Assistant Examiner*—Alfred Dudding
(74) *Attorney, Agent, or Firm*—Crowell & Moring LLP

(57) ABSTRACT

In a printer, an indicator constituted by an LED, for indicating the power-on state of the printer, is provided for an ink carrier, and an indicator window is formed in a cover of the printer. When a power switch is turned on, the indicator is turned on and emits light indicating that the printer is in the power-on state. Then, when the operation of the printer is initiated, the indicator is moved with the ink carrier and its movement is visible through the indicator window, so that confirmation of the operating state of the printer is easily obtained.

17 Claims, 9 Drawing Sheets

PRINTING APPARATUS

BACKGROUND OF THE INVENTION

1. Field of the Invention

The present invention relates to a printing apparatus such as an ink-jet printer, and relates in particular to a printing apparatus for which the operating state can be easily ascertained.

2. Description of the Related Art

FIG. 16 is a view showing the external appearance of a conventional ink-jet printer. In FIG. 16, a printer 100 comprises: a main body 1 of the printer 100; a cover 2, for covering the front face of the main body 1; a sheet feeder 3, which accepts stacks of paper for printing; a power switch 4, which is used to turn the power for the printer 100 on and of f; a reset switch 5, which is used to recover from a printing operation error; discharge rollers 13, for discharging a printed sheet; and an indicator 17, for indicating the power-on state. An ink carrier (not shown) that holds an ink cartridge is reciprocally provided within the main body 1.

When the power switch 4 of the thus arranged printer 100 is turned on, the indicator 17 enters the illuminated state, indicating that the printer 100 is in the power-on state. When the power switch 4 is turned off, the indicator 17 goes to the non-illuminated state, indicating that the printer 100 is in the power-off state. Thus, by observing the indicator 17, a user can ascertain whether the printer 100 is in the power-on state or in the power-off state.

Incidentally, in addition to ascertaining the power-on/power-off state of a printer, it is sometimes necessary to confirm that a printing process is actually being performed. Such as when, for example, the driving of an ink carrier is not performed due to the occurrence of a transportation system malfunction, so that even though sheets of paper are fed normally, nothing is printed on the sheets that are discharged. Accordingly, in this case, it is necessary to confirm that the ink carrier is operating normally. Another reason for this is because if the ink carrier is not operating normally, the printing head will not be cleaned.

Since, with a conventional printer, to confirm that an ink carrier is being driven a user must listen for the sound produced by the motor that moves the carrier, if the location whereat the printer is installed is noisy, or if the printer is at a distance from the user, the sound associated with the operation of the ink carrier is hard to hear, and confirming that the carrier is actually being driven is difficult. Furthermore, although the operation of the ink carrier can be directly confirmed by opening the cover 2, to do so, the user must be physically present at the printer, and thus a lot of labor is involved in the confirmation process.

On the other hand, a convenient added function for an ink-jet printer would be one that indicates a state wherein the supply of ink in an ink cartridge is greatly reduced, or a state wherein the supply of ink is almost exhausted. Such a function is included in a printing apparatus disclosed in Japanese Patent Unexamined Publication No. Hei. 4-275156, wherein an LED (Light-Emitting Diode) that is used to indicate an ink-low or ink-out state is attached to an ink cartridge.

However, since for the printing apparatus disclosed in the above publication a special LED is provided to indicate the ink-low or ink-out state, the number of parts is increased, and the manufacturing cost is higher.

SUMMARY OF THE INVENTION

It is, therefore, an object of the present invention to provide a printing apparatus for which it can be easily and precisely confirmed that the printing apparatus is operating normally.

In order to achieve the above object, according to a first aspect of the invention, there is provided a printing apparatus comprising: an ink carrier; and an indicator provided for the ink carrier for indicating a power-on state, so that when the indicator moves with the ink carrier, it is observed from outside the printing apparatus.

According to a second aspect of the invention, there is provided a printing apparatus comprising: an ink cartridge; and an indicator provided for the ink cartridge for indicating a power-on state, so that when the indicator moves with the ink cartridge, it is observed from outside the printing apparatus.

DETAILED DESCRIPTION OF THE PREFERRED EMBODIMENT

Figure 1:
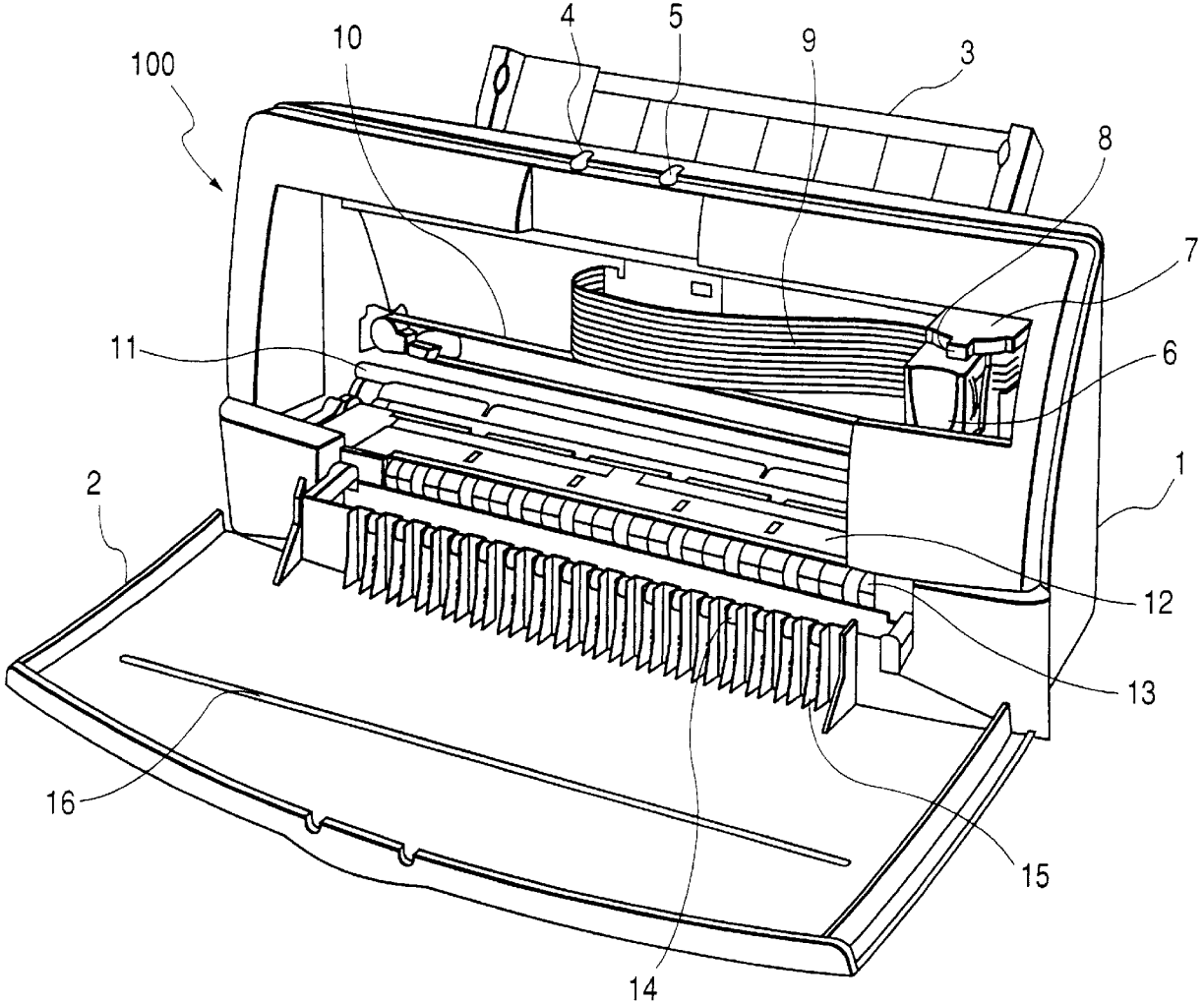
FIG. 1 is a perspective view of a printing apparatus according to one embodiment of the present invention.
Figure 16:
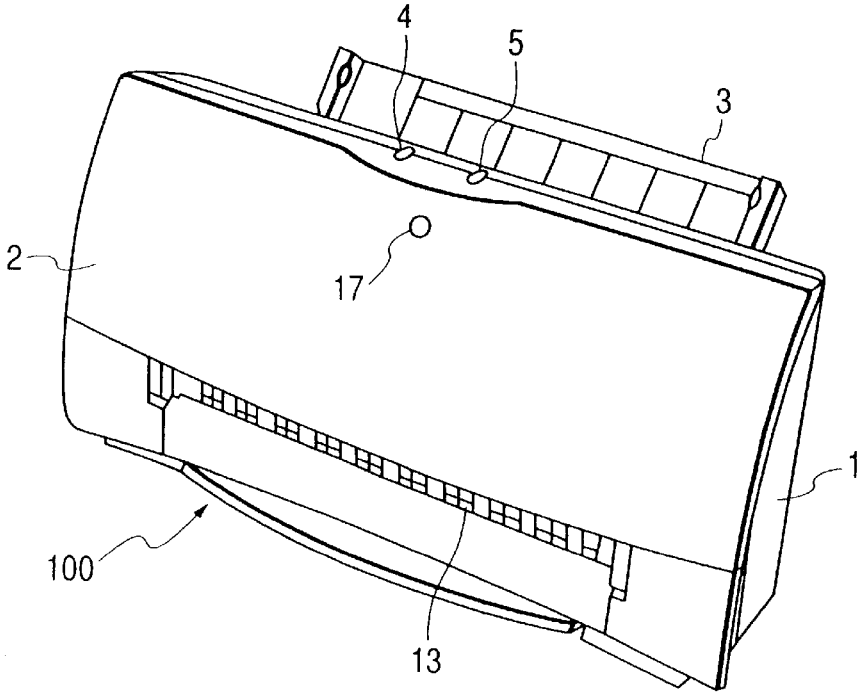
FIG. 16 PRIOR ART
FIG. 16 is a view showing the external appearance of a conventional ink-jet printer.

The preferred embodiment of the present invention will now be described while referring to the drawings. FIG. 1 is a perspective view, according to one embodiment of the present invention, of a printing apparatus with its cover opened. The same reference numerals as are used in FIG. 16 are also used in FIG. 1 to denote corresponding or identical components.

In FIG. 1, a printer 100, which is an ink-jet printer, comprises: a main body 1; a cover 2, which covers the front face of the main body 1; a paper feeder 3, which accepts stacks of paper for printing; a power switch 4, which is used to turn the power for the printer 100 on and off; a reset switch 5, which is used to recover from a printing operation error; and an ink cartridge 6, which is held by an ink carrier 7 that is stored in the main body 1. An indicator 8, which will be described later, is provided for the ink carrier 7.

One end of a flat flexible cable (hereinafter referred to simply as an FFC) 9 is connected to a terminal portion (not shown) provided for the ink carrier 7, and the other end is connected to a printed circuit board, which will be described later. A terminal portion (not shown) for the ink cartridge 6 is so provided that when the ink cartridge 6 is mounted on the ink carrier 7, the terminal portion is electrically connected to the terminal portion of the ink carrier 7. As a result, signals and power are supplied via the FFC 9 to the ink cartridge 6 and to the ink carrier 7.

The printer 100 further comprises: a moving belt 10, which is used when the ink carrier 7 is reciprocally moved by a motor (not shown); a primary shaft 11, which is used to guide the ink carrier 7; a platen 12, which serves as a reference face when a sheet (not shown) that has been supplied from the paper feeder 3 is printed; discharge rollers 13, which discharge a printed sheet; wheels 14, which are provided for the cover 2 and which face the discharge rollers 13; support walls 15, which support the wheels 14; and an indicator window 16, which is formed in the cover 2.

Figure 2:
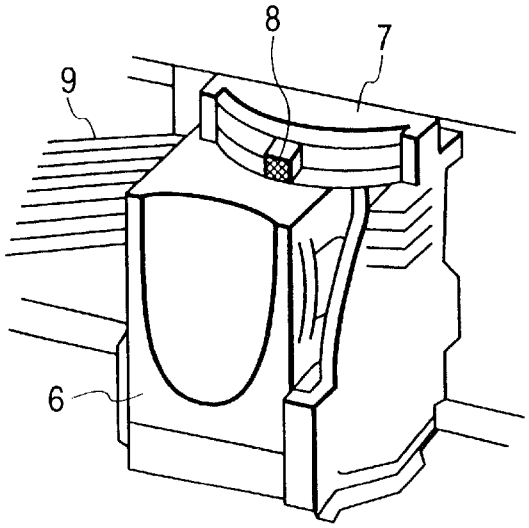
FIG. 2 is an enlarged perspective view of the essential portion in FIG. 1.

FIG. 2 is a partially enlarged view of the ink cartridge 6 and the ink carrier 7 in FIG. 1. The indicator 8 is located on the ink carrier 7, and is moved with the ink carrier 7. The indicator 8 is constituted by a light-emitting diode (hereinafter referred to simply as an LED), and is electrically connected to the FFC 9. The indicator 8 can be constituted by a lamp instead of an LED.

Figure 3:
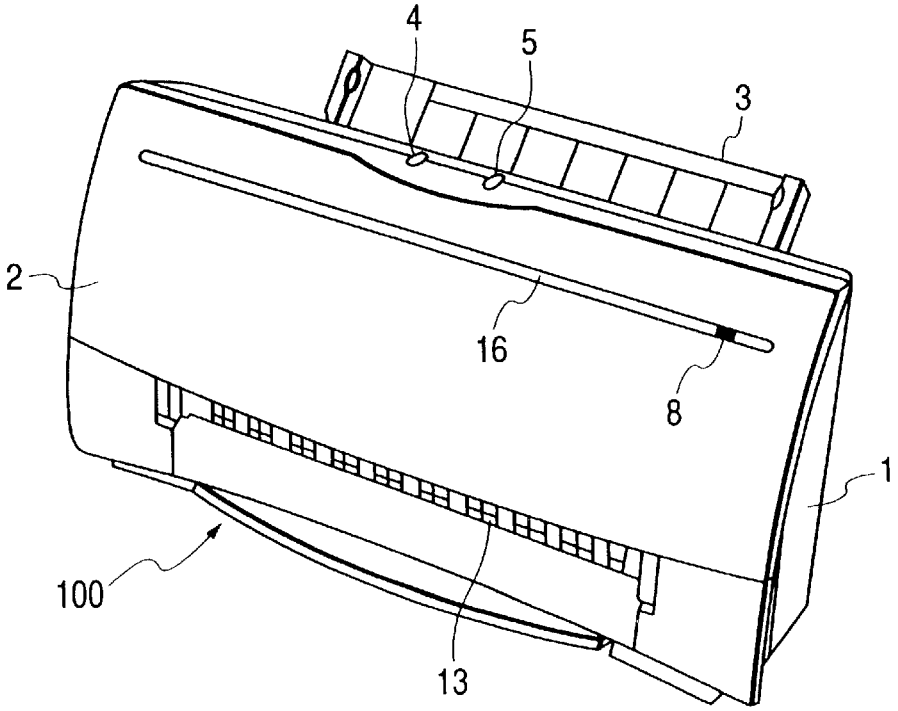
FIG. 3 is a perspective view of the printing apparatus when the cover in FIG. 1 is closed.

FIG. 3 is a perspective view of the printer with the cover 2 in FIG. 1 closed. When the cover 2 is closed, the indicator 8 is located opposite the indicator window 16, so that the indicator 8 can be observed through the indicator window 16.

The indicator window 16 is formed as a long slit and is substantially parallel to the direction in which the ink carrier 7 is moved. Therefore, as the ink carrier 7 is moved, the indicator 8 is moved along the indicator window 16 from right to left, or from left to right.

Figure 4:
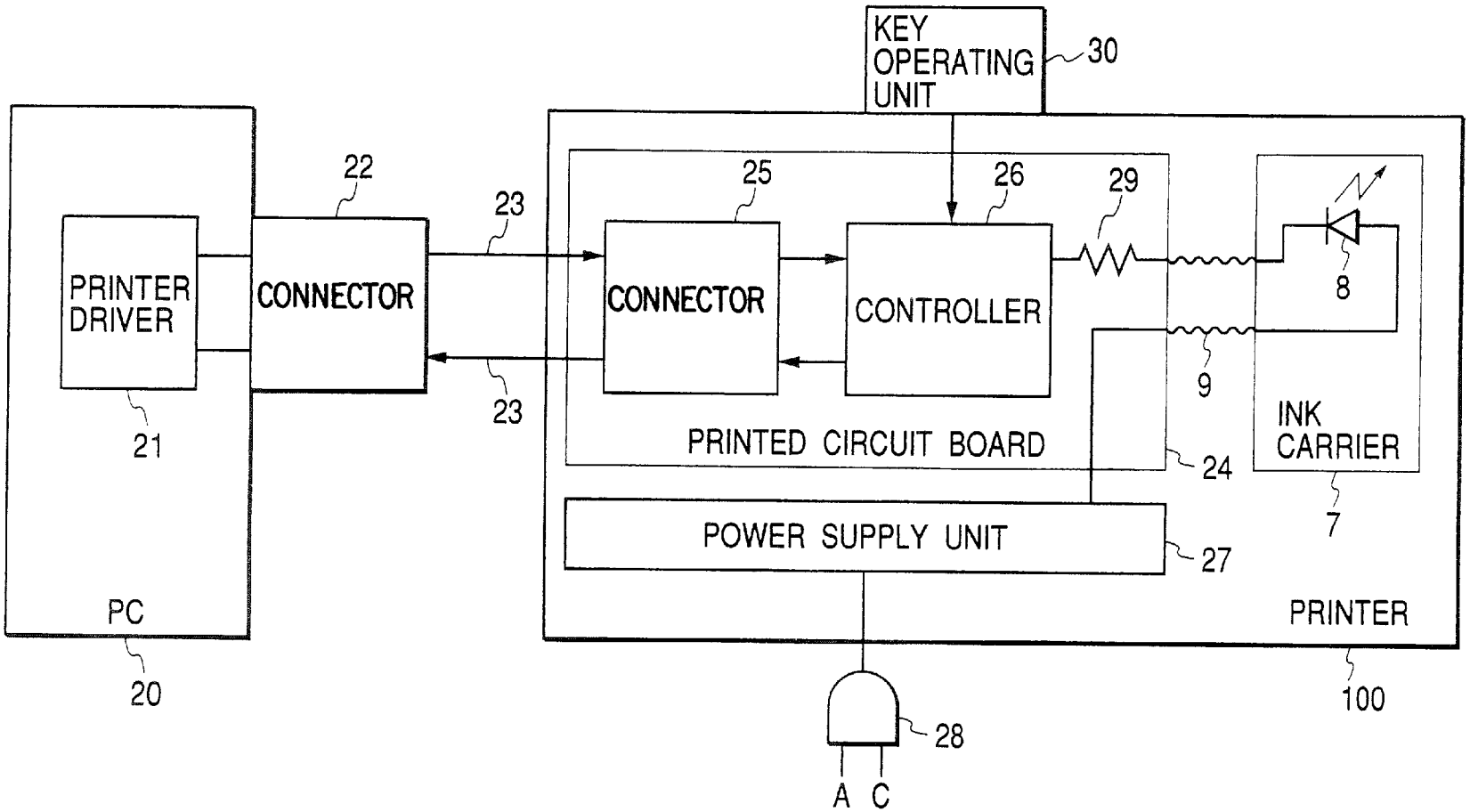
FIG. 4 is a block circuit diagram illustrating the electrical arrangement of the printing apparatus in FIG. 1.

FIG. 4 is a block circuit diagram illustrating the electrical arrangement of the essential portion of the printer 100. In FIG. 4, the printer 100 is connected to a personal computer (hereinafter referred to simply as a PC) 20. The same reference numerals as are used in FIGS. 1 to 3 are also used in FIG. 4 to denote corresponding components.

In FIG. 4, the PC 20 incorporates a printer driver 21, which is connected to a connector 22. The connector 22 is connected, by a cable 23, to a connector 25 that is attached to a printed circuit board 24 in the printer 100, and the connector 25 is connected to a controller 26 that is mounted on the printed circuit board 24. The controller 26 includes aCPU, a memory and the like (notshown). With this arrangement, the printer driver 21 of the PC 20 is electrically connected to the controller 26 of the printer 100, so that the PC 20 and the printer 100 can exchange data.

A power supply unit 27, for supplying power to the individual sections of the printer 100, includes a rectifier (not shown) for rectifying an alternating-current voltage received from a plug 28 that is connected to an alternating-current power source. The ink carrier 7 includes the indicator 8 that is constituted by an LED. As was explained while referring to FIG. 1, the ink carrier 7 is connected to the printed circuit board 24 by the FFC 9, and the cathode of the LED 8 is connected via a current-limiting resistor 29 to the controller 26, while the anode of the LED 8 is connected to the power supply unit 27. A key operating unit 30 is constituted by the power switch 4 and the reset switch 5 in FIG. 1.

In the thus arranged printer 100, when the power switch 4 of the key operating unit 30 is depressed, the controller 26 in FIG. 4 detects this depression, a path is formed along which a current flows from the power supply unit 27 via the FFC 9 to the indicator 8 and the current-limiting resistor 29, and the indicator 8 emits, for example, green light. Thereafter, the light emitted by the indicator 8 is projected through the indicator window 16 in FIG. 3, so that it is visible outside the printer 100. Then, when the power switch 4 is depressed again, the controller 26 detects this depression and blocks the path along which current is flowing to the indicator 8, turning the indicator 8 off and halting the projection of light through the indicator window 16. As a result, since no light is visible through the indicator window 16, it can be determined from outside the printer 100 that the indicator 8 is in the off-state. Therefore, since confirmation of the on-state or the off-state of the indicator 8 can be obtained by observing the indicator window 16, whether the printer 100 has been powered on or off can be readily ascertained.

When a key or a mouse (not shown) is used to enter a printing instruction for the PC 20, a print command signal is transmitted by the printer driver 21, via the connector 22, the cable 23 and the connector 25, to the controller 26 of the printer 100, and based on the command signal, operation of the printer 100 is initiated. When the printer 100 is operating, the ink carrier 7 in FIG. 1, conveyed by the moving belt 10, which is driven by a motor (not shown), reciprocates from one end to the other of the primary shaft 11. During this movement, the printing of a sheet of paper is performed by a print head (not shown) on the bottom of the ink cartridge 6.

As the ink carrier 7 is conveyed by the moving belt 10, the indicator 8, which is provided for the ink carrier 7, is also moved. In this case, since the printer 100 is in the power-on state, light is emitted by the indicator 8. Therefore, when the indicator 8, which emits green light, is moved from left to right and back again along the indicator window 16, at the same speed as that of the ink carrier 7, this movement can be observed from outside the printer 100. In this manner, since while the indicator 8 is in the on-state its movement can be observed through the indicator window 16, it can be readily ascertained that the printer 100 is operating.

On the other hand, when the printing is completed, the ink carrier 7 is returned to its home position (the position shown in FIG. 1) and is halted there, as is the indicator 8. However, since at this time power is still being supplied to the printer 100, the indicator 8 remains on, and as it can be seen through the indicator window 16 that the indicator 8, still in the on-state, has been halted, it can therefore be ascertained that operation of the printer 100 has halted. Also, when there is a malfunction of the moving system of ink carrier 7, and movement of the ink carrier 7 ceases, the state that the indicator 8 has been halted can be seen through the indicator window 16 and it can be ascertained that the printer 100 has stopped operating.

As is apparent from the above description, the indicator 8 is used to indicate the power-on state of the printer 100, as well as its operating state. Since the two indicating functions are provided by the single indicator 8, special indicators for those functions need not be separately provided, and an increase in the manufacturing cost can be avoided. Further, the operational state can be identified by observing the movement of the indicator, rather than be listening for the sounds the ink carrier makes while it is moving, as in the conventional printer. Therefore, even when the printer 100 is installed in a very noisy place, or at a distance from a user, its operating state can readily be determined, without opening the cover 2. In addition, since the horizontal movement of the indicator 8 in the on-state can be seen through the slit-shaped indicator window 16 in the cover 2, an additional interior decoration effect can be provided by the printer 100.

Figure 5:
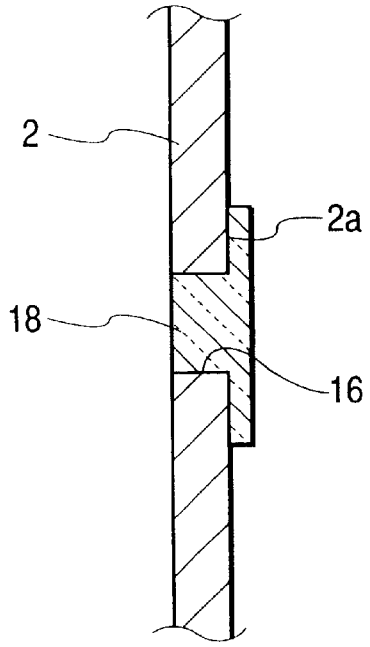
FIG. 5 is an enlarged cross-sectional view of a part (a light-transmitting member) of an indicator window.

Incidentally, the indicator window 16 in the cover 2 may be formed simply as a through-hole. However, dust or dirt may enter the printer 100 via the through-hole and cause an operating failure. In order to avoid this, it is preferable that the indicator window 16 be covered with a light-transmitting member. FIG. 5 is an enlarged cross-sectional view of one part of the indicator window 16 in this embodiment. The indicator window 16 in the cover 2 is closed by a light-transmitting member 18 to prevent the entry of dust or dirt. The light-transmitting member 18 is, for example, transparent plastic, and is fixed to the rear face 2*a* of the cover 2 by an adhesive or the like. The light-transmitting member 18 may be secured by resin molding, thermal welding or pressurizing. The material that is used for the light-transmitting member 18 is not limited to plastic, and may be glass or the like.

Figure 6:
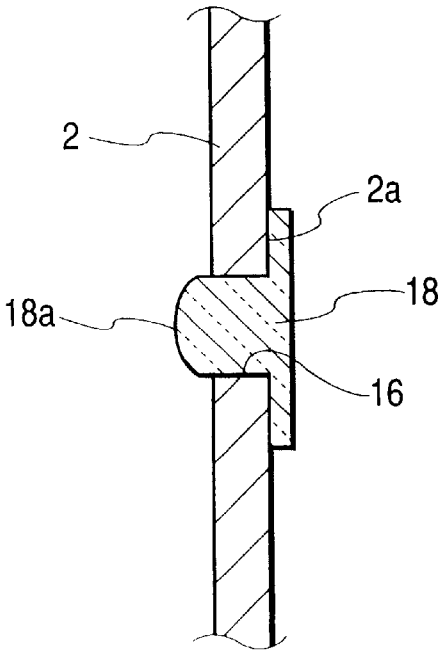
FIG. 6 is an enlarged cross-sectional view of another example of a part of an indicator window.

FIG. 6 is a cross-sectional view of another example of the light-transmitting member 18. A lens portion 18*a* is formed for the light-transmitting member 18 and projects outward slightly from the obverse side of the cover 2. The remaining arrangement details are the same as those for FIG. 5. Since the transparent lens which includes the lens portion 18a is employed as the light-transmitting member 18, the indication provided by the indicator 8 is enlarged, so that emitted light can be seen more easily outside the printer 100. Instead of a transparent lens, a translucent lens can also be used as the light-transmitting member 18. Since the internal mechanism of the apparatus can not be seen through the translucent lens, the appearance of the apparatus is not degraded, and since a mottled pattern is indicated due to the light diffusion that is produced as the indicator 8 is moved, an improved interior design effect can be provided.

Figure 7:
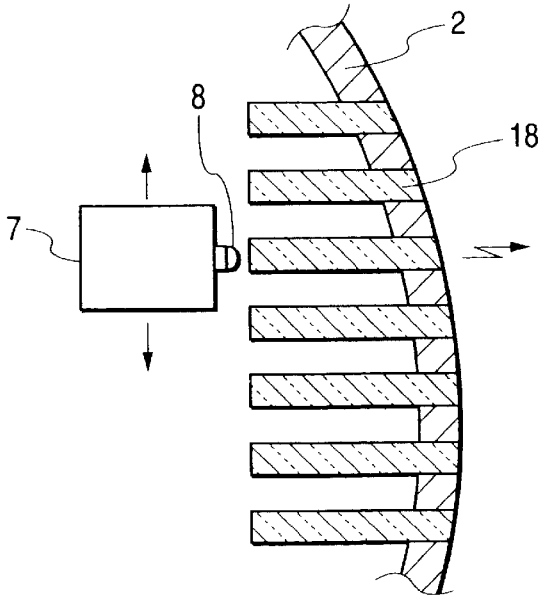
FIG. 7 is an enlarged cross-sectional view of an additional example of light transmitting members.
Figure 8A:
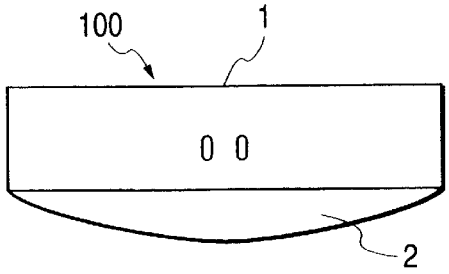
FIGS. 8(*a*), 8(*b*) and 8(*c*) are a plan view, a front view and a side view of an printing apparatus for which the example in FIG. 7 is applied.
Figure 8B:
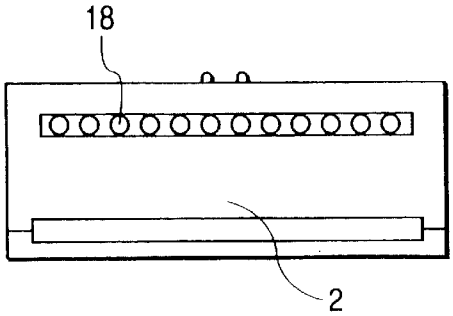
Figure 8C:
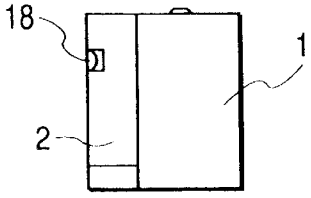

FIG. 7 is a cross-sectional view of an additional example of a preferable light-transmitting member 18 for the printer 100 in FIGS. 8(*a*) to 8(*c*), which has a cover 2 that is curved in the direction in which the ink carrier is moved. FIG. 8(*a*) is a plan view of the printer 100, FIG. 8(*b*) is a front view thereof and FIG. 8(*c*) is a side view thereof. In FIG. 7, a plurality of light-transmitting members 18 are arranged in line along the direction in which the ink carrier 7 is moved. One end of each of the light-transmitting members 18, which are arranged at equal intervals and are securely held by a common holder (not shown), faces outward through the cover 2, and the other end faces the position occupied by the indicator 8 as it is moved past the light-transmitting members 18.

With this arrangement, as the ink carrier 7 is moved, light from the indicator 8 is projected through each light-transmitting member 18, in order, to the outside, so that viewed from the front of the cover 2 it appears that a series of lamps are being turned on, one by one. Furthermore, since light is concentrated by the individual light-transmitting members 18, the degree of brightness of the light is increased and the movement of the indicator 8 can be observed more easily. In addition, since equal intervals are maintained between the light-transmitting members 18 and the indicator 8, even when the ink carrier 7 is moved, the light emitted by the indicator 8 is guided uniformly to the outside though the cover 2, which is curved, so that an indication of lights of equal brightness can be provided.

Figure 9A:
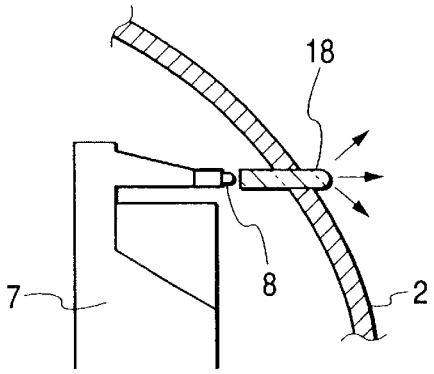
FIGS. 9(*a*) and 9(*b*) are enlarged cross-sectional views of a further embodiment for which the light-transmitting member is employed.
Figure 9B:
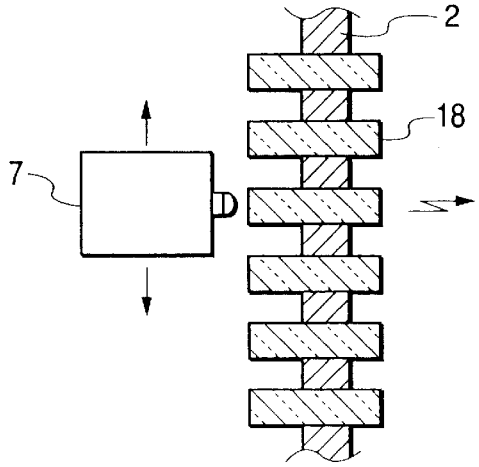
Figure 10A:
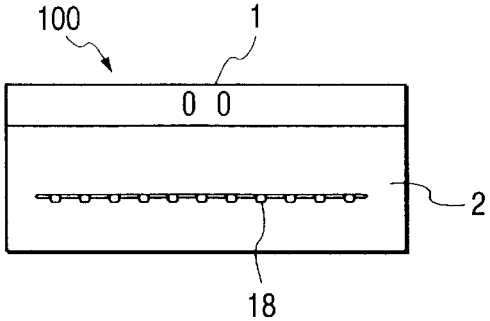
FIGS. 10(*a*), 10(*b*) and 10(*c*) are a plan view, a front view and a side view of an printing apparatus for which the example in FIGS. 9(*a*) and 9(*b*) is applied.
Figure 10B:
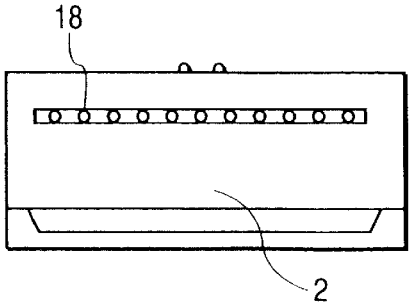
Figure 10C:
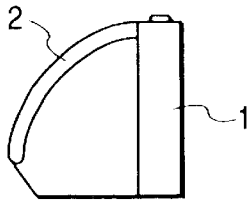

FIGS. 9(*a*) and 9(*b*) are views showing a further example of a light-transmitting member 18 that is preferable for the printer 100 in FIGS. 10(*a*) to 10(*c*), which has a cover 2 that is curved perpendicularly to the direction in which the ink carrier is moved. FIG. 10(*a*) is a plan view of the printer 100, FIG. 10(*b*) is a font view thereof and FIG. 10(*c*) is a side view thereof. As is shown in FIG. 9(*b*), a plurality of light-transmitting members 18 are arranged along the direction in which the ink carrier 7 is moved, with their external ends projecting outward from the cover 2, and their other ends positioned so they face, at equal intervals, the indicator 8 as it is moved past them.

Since the same indication form as in FIG. 7 is employed for the above arrangement, the movement of the indicator 8 can be easily observed. As is shown in FIG. 9(*a*), light emitted by the indicator 8 is not only guided to the external ends of the light-transmitting members 18, but is also projected obliquely upward, at a spread angle, from those ends by directivity. Thus, the light from the indicator 8 can be observed from obliquely above as well as from the front of the apparatus.

Figure 11:
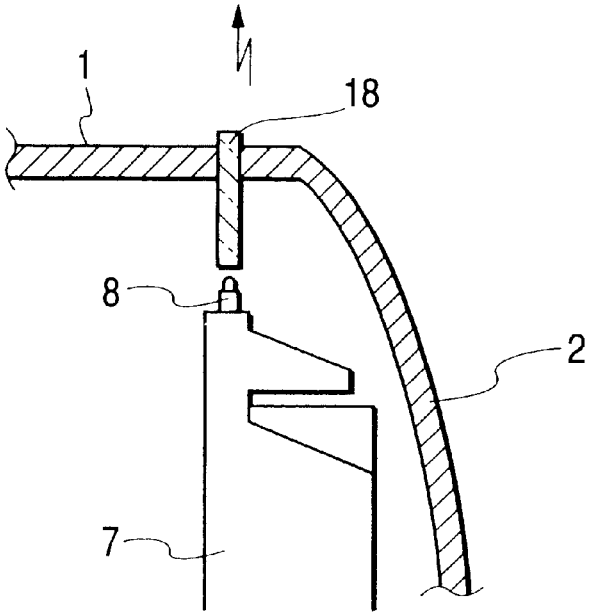
FIG. 11 is an enlarged cross-sectional view of one further example of a light-transmitting member.
Figure 13A:
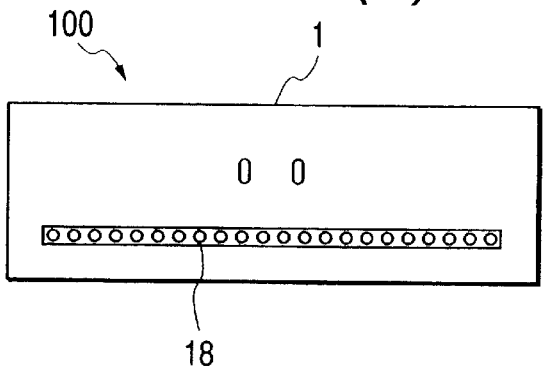
FIGS. 13(*a*), 13(*b*) and 13(*c*) are a plan view, a front view and a side view of an printing apparatus for which the example in FIG. 11 is applied.
Figure 13B:
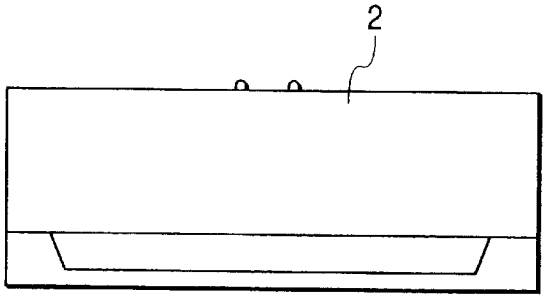
Figure 13C:
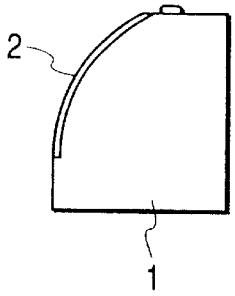

FIG. 11 is a view showing a further example of a light-transmitting member 18 that is preferable for a printer 100 depicted in FIGS. 13(*a*) to 13(*c*), where in response to a design request an indicator window 16 is not formed in the front cover 2 or where the wall of the cover 2 is thin. FIG. 13(*a*) is a plan view of the printer 100, FIG. 13(*b*) is a front view thereof and FIG. 13(*c*) is a side view thereof. In FIG. 11, the indicator 8 is located on the top of the ink carrier 7, and light produced by the indicator 8 is projected upward. On the other hand, the light-transmitting members 18 are arranged along the direction in which the ink carrier 7 is moved (perpendicularly to the face of the sheet of paper), so that their upper ends pass through the top of the printer 100 to the outside. With this arrangement, light from the indicator 8 can be observed from above the apparatus via the light-transmitting members 18.

Figure 12:
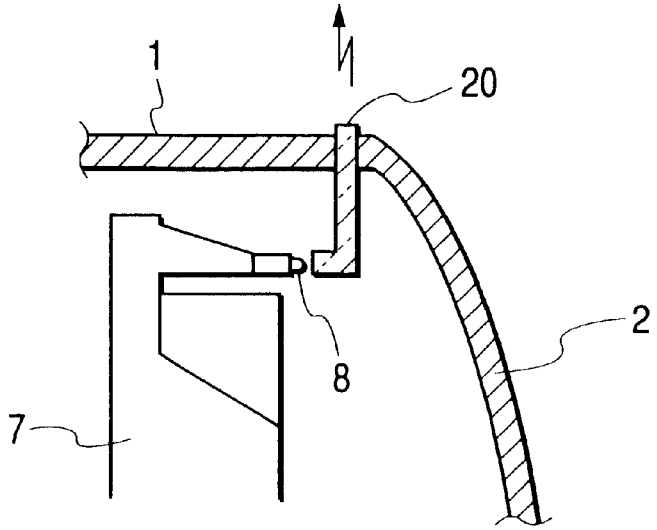
FIG. 12 is an enlarged cross-sectional view of a modification for which an optical fiber member is employed.

FIG. 12 is a view showing a modification of FIG. 11 where an optical fiber 20 is employed instead of the light-transmitting member 18. In FIG. 12, the indicator 8 is located on the front of the ink carrier 7 and light is emitted horizontally by the indicator 8. The horizontal light is guided upward along the optical fiber 20 that is curved to form a perpendicular optical guide path, and is projected upward from the external surface of the top of the main body 1. With this arrangement, light can be guided so that it is projected in arbitrary directions, regardless of the position of the indicator 8.

In the above embodiment, the indicator 8 has the two functions: power-on indication and operation indication. An ink volume state indication function can be additionally provided. With this function, when the ink volume remaining in the ink cartridge 6 falls to a predetermined or smaller level, an ink-low state is indicated, or when the remaining ink is almost exhausted, an ink-out state is indicated. When the ink-low state is indicated, it means that it is almost time for the ink cartridge 6 to be replaced, while when the ink-out state is indicated, it means that the ink cartridge 6 must be replaced.

A method described in detail in, for example, Japanese Patent Unexamined Publication No. Hei. 4-275156, can be employed in order to permit the indicator 8 to indicate the above ink volume state. According to this method, the controller 26 counts the number of times the print head of the ink cartridge 6 is powered on, and when a predetermined count value is reached, the ink-low state is indicated. Then, when an even greater count value is reached, the ink-out state is indicated. The timing for indicating these states may also be determined by counting the cumulative printing time, instead of counting the power-on states. In addition, the timing for indicating the individual states may be determined by actually measuring the volume of the ink remaining in the ink cartridge 6.

Since the above ink volume state indication function is provided by the indicator 8, the indicator 8 can perform the three functions. It can identify the power-on state, identify the operating state, and identify the ink volume state. In order to distinguish between the means used to identify these states, various indication forms can be employed. For example, the power-on state can be indicated by having the indicator 8 emit green light when it is turned on, the operating state can be indicated by moving the green indicator 8, and the ink volume state can be indicated by having the indicator 8 emit red light when it is turned on. It is preferable that a two-color LED that emits green light and red light be used for such an indicator 8.

In addition, to indicate the volume of the remaining ink, the ink-low state can be indicated by the indicator 8 emitting blinking red light, and the ink-out state can be indicated by the indicator 8 emitting steady red light. Alternatively, the ink-low state may be indicated by the indicator 8 emitting steady red light, and the ink-out state may be indicated by the indicator 8 emitting blinking red light.

Further, only one of the ink-low and ink-out states may be indicated. In this case, the power-on state can be indicated by having the indicator 8 emit green light, and the ink-low or ink-out state can be indicated by having the indicator 8 emit red light. Furthermore, a normal LED that emits only one light color can be employed as the indicator 8, and to indicate the power-on state, the indicator 8 can emit steady light, while to indicate the ink-low or ink-out state it can emit blinking light. Alternatively, the indicator 8 can emit blinking light to indicate the power-on state, and steady light to indicate the ink-low or ink-out state.

Since the ink volume state indication function is additionally provided for the indicator 8, the volume of the ink remaining in the cartridge 6 can be easily understood. Further, since the single indicator 8 performs the three functions, special indicators for the individual functions need not be separately provided, and a further increase in the manufacturing cost can be prevented.

Figure 14:
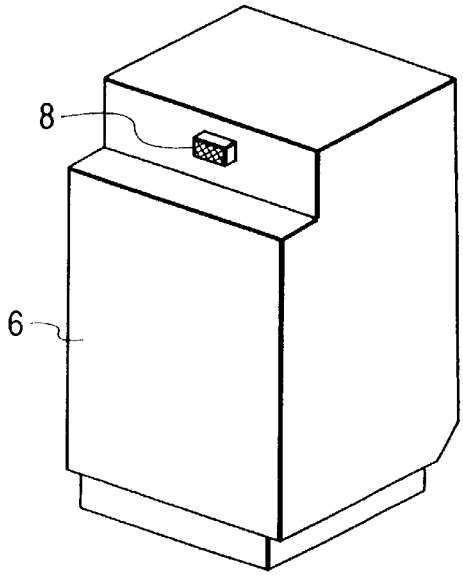
FIG. 14 is a perspective view of a modification of the ink cartridge of the present invention.

In the above-described embodiment, the indicator 8 is provided for the ink carrier 7. However, as shown in FIG. 14, the indicator 8 may be provided for the ink cartridge 6. Also in this case, the indicator 8 indicates the power-on state and the operating state of the printer 100, or additionally indicates the ink remaining state.

Figure 15:
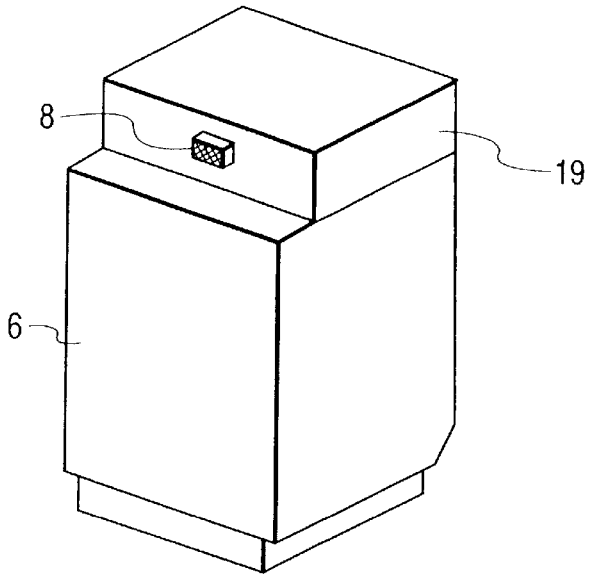
FIG. 15 is a perspective view of another modification of the ink cartridge.

FIG. 15 is a view showing a modification according to which an indicator 8 is added to an ink cartridge 6. In this case, the indicator 8 is provided as part of an indicating unit 19 that is removed from the top of the ink cartridge 6, for example, by detaching it from a connector (not shown). With this arrangement, when the ink in the ink cartridge 6 is exhausted, the indicating unit 19 can be removed and reused by attaching it to a replacement ink cartridge 6.

An explanation has been given for the preferred embodiment. However, the present invention is not limited to the above embodiment, and can be variously modified without departing from the technical concept of the present invention. Further, although in the above embodiment an ink-jet printer is employed as the printing apparatus, the present invention can also be applied for a printer that uses an ink ribbon, and the ink carrier in this invention includes a support member for an ink ribbon in such a printer.

According to the present invention, since the power-on state indicator is provided for the ink carrier or the ink cartridge, and the movement of the indicator can be observed from outside the printing apparatus, the operating state can be easily and visually ascertained. Further, since the indicator can be used for both power-on state confirmation and operating state confirmation, a separate indicator is not required for operating state confirmation. Thus, the number of parts is not increased and the manufacturing cost can be reduced.

Further, since the movement of the indicator can be observed through a slit-shaped indicator window, an interior decoration function effect can be additionally provided for the printing apparatus, and the indicator window can be covered by a light-transmitting member to prevent dust or dirt from entering the interior. In addition, when a transparent lens is used for the light-transmitting member, the indicator can be observed from outside more easily; and when a translucent lens is used for the light-transmitting member, the view of the internal mechanism can be blocked, and a mottled pattern due to light diffusion can be indicated that adds to the interior decoration effect provided by the apparatus.

A plurality of light-transmitting members can be arranged along the direction in which the ink carrier is moved, with one end of each light-transmitting member facing the exterior and the other end facing the position occupied by the indicator when it is opposite the light-transmitting member. Thus, the light is concentrated by the individual light-transmitting members and its brightness is increased, making it easier to observe the indicator. For a printing apparatus having a cover that is curved in the direction in which the ink carrier is moved, a plurality of light-transmitting members are arranged with their distal ends passing through the cover and their other ends positioned so they face, at equal intervals, the indicator as it is moved past them. Therefore, the light emitted by the indicator is guided uniformly to the exterior, and a indication having a constant, even brightness can be provided. Further, for a printing apparatus having a cover that is curved perpendicularly to the direction in which the ink carrier is moved, the ends of the light-transmitting members project outward from the external surface of the cover, so that light produced by the indicator can be observed from obliquely above the apparatus. In addition, the light-transmitting members can be positioned so that their upper ends pass through the top of the apparatus and light from the indicator can be observed from directly above. When optical fiber members are employed instead of the light-transmitting members, light can be guided so that it is projected in arbitrary directions.

Furthermore, when the indicator is used to indicate the ink volume state, as well as the power-on state and the operating state, the amount of ink that remains can be easily apprehended. Also, since the single indicator is used for the three indication functions, the manufacturing cost can be further reduced. In addition, when different indicating methods are employed, such as when different colors are used for the power-on state and the ink volume state, the states that are represented can be easily identified.

As for the indicator, when one can be detached from an ink cartridge, it can be reused.

What is claimed is:

1. A printing apparatus comprising:

an ink carrier; and a power on/off indicator provided for the ink carrier for indicating a power-on/off state of the printing apparatus, said indicator moving with the ink carrier and being observable from outside the printing apparatus.

2. The printing apparatus according to claim 1, further comprising an indicator window that consists of a slit that is formed substantially parallel to a direction in which the ink carrier moves, so that the indicator is observed through the indicator window from outside the printing apparatus.

3. The printing apparatus according to claim 2, wherein the indicator window is closed by a light transmitting member.

4. The printing apparatus according to claim 3, wherein the light transmitting member is formed of a transparent lens.

5. The printing apparatus according to claim 3, wherein the light transmitting member is formed of a translucent lens.

6. The printing apparatus according to claim 1, wherein a plurality of light transmitting members are arranged along a path followed by the ink carrier when it is moved, with one end of each of the light transmitting members facing outward, and the other end facing the indicator.

7. The printing apparatus according to claim 6, further comprising a cover that is curved in the direction in which the ink carrier is moved, wherein one end of each of the light-transmitting members, which are arranged at substantially equal intervals, faces the outside through the cover, and the other end faces the position occupied by the indicator as it is moved past the light-transmitting member.

8. The printing apparatus according to claim 6, further comprising a cover that is curved perpendicularly to the direction in which the ink carrier is moved, wherein one end of each of the light transmitting members is extended so it projects outward through the cover.

9. The printing apparatus according to claim 6, wherein the end of each of the light transmitting members projects outward and is pointed up.

10. The printing apparatus according to claim 6, wherein optical fiber members are employed instead of the light transmitting members, and wherein light from the indicator is projected in arbitrarily selected directions.

11. The printing apparatus according to claim 1, wherein the indicator is employed not only to indicate a power-on state but also to indicate an ink volume state of an ink cartridge held by the ink carrier.

12. The printing apparatus according to claim 11, wherein the power-on state and the ink volume state are identified in different indication forms.

13. The printing apparatus according to claim 12, wherein different colors are used for the two states.

14. The printing apparatus according to claim 13, wherein a two-color light-emitting diode is employed as the indicator.

15. The printing apparatus according to claim 12, wherein one of the power-on state and the ink volume state is indicated by blinking light, and the other by steady light.

16. A printing apparatus comprising:

an ink cartridge; and a power on/off indicator provided for the ink cartridge for indicating a power-on/off state of the printing apparatus, said indicator moving with the ink cartridge and being observable from outside the printing apparatus.

17. The printing apparatus according to claim 16, wherein the indicator is detachable from the ink cartridge.

* * * * *